US007186129B2

(12) United States Patent
Shimizu et al.

(10) Patent No.: US 7,186,129 B2
(45) Date of Patent: Mar. 6, 2007

(54) LOCK STRUCTURE AND CONNECTOR WITH LOCK MECHANISM OF LOCK STRUCTURE

(75) Inventors: Kazuomi Shimizu, Aichi (JP); Akihiko Onchi, Aichi (JP); Daisuke Miyachi, Aichi (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 11/037,181

(22) Filed: Jan. 19, 2005

(65) Prior Publication Data

US 2005/0181666 A1 Aug. 18, 2005

(30) Foreign Application Priority Data

Jan. 20, 2004 (JP) ..... 2004-012247

(51) Int. Cl.
*H01R 13/627* (2006.01)

(52) U.S. Cl. ..... 439/358; 439/372

(58) Field of Classification Search ..... 439/350, 439/353, 354, 357, 358, 372
See application file for complete search history.

(56) References Cited

U.S. PATENT DOCUMENTS

| | | | | |
|---|---|---|---|---|
| 3,523,269 | A * | 8/1970 | Bissland et al. | 439/358 |
| 4,188,086 | A * | 2/1980 | Inouye et al. | 439/496 |
| 4,341,428 | A * | 7/1982 | Hatch et al. | 439/372 |
| 4,944,693 | A * | 7/1990 | Puerner | 439/358 |
| 5,154,629 | A * | 10/1992 | Carver et al. | 439/352 |
| 5,378,168 | A * | 1/1995 | Sumida | 439/358 |
| 6,358,091 | B1 | 3/2002 | Lo et al. | |
| 6,579,113 | B2 * | 6/2003 | Kodama | 439/358 |
| 6,945,808 | B1 * | 9/2005 | Hisamatsu | 439/358 |
| 2003/0139082 | A1 | 7/2003 | Aramoto et al. | |

FOREIGN PATENT DOCUMENTS

| | | |
|---|---|---|
| DE | 31 05 808 A1 | 9/1982 |
| EP | 0 848 456 A2 | 6/1998 |
| EP | 1 133 025 A2 | 9/2001 |

(Continued)

OTHER PUBLICATIONS

European Search Report, Application No. 05001043.8-2214, dated May 18, 2005.

*Primary Examiner*—Thanh-Tam Le
(74) *Attorney, Agent, or Firm*—Rader, Fishman & Grauer PLLC

(57) ABSTRACT

A connector with a lock mechanism is provided. The lock mechanism 11 comprises a lock arm 3 provided on an outer surface of a plug frame 10A and a pair of supports 5A, 5B arranged near respective lateral ends of the lock arm 3. The pair of supports 5A, 5B are formed integrally to protrude from the outer surface of the plug frame 10A. A pair of torque rods 4A, 4B being fixed to the pair of supports 5A, 5B support the lock arm 3 on respective lateral ends such that a hook 3A to be latched on a receptacle 2 may swing around the rods 4A, 4B. A forward portion 30F including the hook 3A is formed with a concaved portion A1 of a forward slide mold 3F. A latch face 32 of the hook 3A is formed with a projecting portion B1 of a backward slide mold 3R.

18 Claims, 12 Drawing Sheets

FOREIGN PATENT DOCUMENTS

| | | | |
|---|---|---|---|
| FR | 2 721 791 | A1 | 6/1994 |
| GB | 1 492 951 | | 11/1977 |
| GB | 2 195 501 | A1 | 4/1988 |
| JP | 62-25479 | U | 2/1987 |
| JP | 01-137572 | A | 5/1989 |
| JP | 5-251135 | A | 9/1993 |
| JP | 9-180813 | A | 7/1997 |
| JP | 2000-21475 | A | 1/2000 |
| JP | 2000-164294 | A | 6/2000 |
| JP | 2002-280109 | A | 9/2002 |

* cited by examiner

LOCK STRUCTURE AND CONNECTOR WITH LOCK MECHANISM OF LOCK STRUCTURE

CROSS-REFERENCE TO RELATED APPLICATIONS

This application is based upon and claims the benefits of priorities from Japanese Patent Application No. 2004-012247 filed on Jan. 20, 2004, the entire contents of which are incorporated herein by reference.

This application is related to a co-pending U.S. patent application entitled "Connector with Lock Mechanism," and being filed on even date herewith. The co-pending application is expressly incorporated herein by reference.

1. Field of the Invention

The present invention relates to a connector for electric connection, having a lock mechanism that maintains connection with a mating connector.

2. Related Art

A set of connectors for electric connection is configured such that a plug including a socket contact with a plurality of cables and a receptacle with a plurality of pin contacts are coupled with each other. In this case, the receptacle is mounted on an electric equipment or on a side electric equipment side and the plug with cables is connected to and removed from the receptacle.

In some cases, a lock mechanism may be provided with such a connector for electric connection in order to make it sure that the plug and the receptacle are kept connected. In particular, the plug for the cable connection may often be provided with such a lock mechanism.

For such a connector (plug) with a lock mechanism, a plug housing with an outer surface having a lock mechanism is conventionally formed with two slide dies such that a manufacturing cost therefor is high. However, there is provided a connector to reduce the manufacturing cost (for example, see JP-A-2000-164294).

In JP-A-2000-164294 indicated above, an intermediate portion of a lock arm of a lock mechanism is supported by a support to be able to elastically perform swinging displacements. The lock arm includes a first portion positioned relative to the support in a mount direction and a second portion positioned in an opposite direction to the connection direction. The first portion includes a hook and the second portion includes a finger depressing portion. The first portion includes a recess on a side of the support in the connection direction, and the recess on an outer surface is formed with a main die, which is moved in a direction perpendicular to the outer surface.

FIG. 9 is a schematic, perspective view showing a plug with a lock mechanism and a mating receptacle of the invention described in JP-A-2000-164294. FIG. 9 of the present application corresponds to FIG. 1 in JP-A-2000-164294. Also, FIG. 10 is a vertical, cross sectional view showing both connectors housing in a coupled state of the invention described in JP-A-2000-164294. FIG. 10 of the present application corresponds to FIG. 3 in JP-A-2000-164294.

In FIG. 9, a receptacle 98 is fixed to a surface of a printed board 90. A plug 9A is mounted to ends of a plurality of cables 9C arranged in parallel with each other. The plug 9A is coupled to the receptacle 9B.

The receptacle 9B comprises a receptacle housing 91 made of a synthetic resin and a plurality of terminals 91A. The plurality of terminals 91A extend through the receptacle housing 91 and are arranged laterally. The terminals 91A projecting downwardly of the receptacle housing 91 are fixed at front ends thereof to the printed board 90 by means of soldering.

The receptacle housing 91 is open at an end surface on a coupling face and comprises an insertion and extraction recess 91B to permit insertion and extraction of a part of a corresponding mating plug 9A. The plurality of terminals 91A are aligned and arranged in the insertion and extraction recess 91B.

A pair of engagement projections 93A and 93B are formed on an outer surface of the receptacle housing 91. The pair of engagement projections 93A and 93B are latched on and engaged with hooks 92A and 92B of a lock mechanism 92 on a side of the plug 9A. The pair of engagement projections 93A and 93B are formed in recesses 93C and 93D on both sides and the recesses 93C and 93D are separated by a vertical rib 93L.

Since the respective engagement projections 93A and 93B are formed over entire widths of the corresponding recesses 93C and 93D, these portions are strong. The respective engagement projections 93A and 93B comprise inclined guides 93E and 93F for guiding the hooks 92A and 92B for engagement.

On the other hand, provided on an outer surface of a plug housing 94 is a plate-shaped lock arm 92L, which is arranged in parallel to the outer surface. A pair of supports 92M (see FIG. 10) formed on the outer surface to project therefrom elastically support an intermediate portion of the lock arm 92L to make the same capable of swinging displacement. The pair of supports 92M connect both widthwise sides of the lock arm 92L to the outer surface of the plug housing 94.

As shown in FIG. 10, the lock arm 92L comprises a first portion 921 positioned relative to the supports 92M in a direction A of connecting to the mating receptacle 9B, and a second portion 922 positioned relative to the supports 92M in a direction B opposite to the connecting direction. The first portion 921 includes hooks 92A and 92B being latched on and engaged by the engagement projections 93A and 93B of the mating receptacle 9B. The second portion 922 includes a finger depressing portion 92F. The hooks 92A and 92B are provided over an entire width of the first portion 921 to achieve enough strength of the first portion 921.

In this manner, the supports 92M elastically support the intermediate portion of the lock arm 92L on the lock mechanism 92 to make the same capable of swinging displacement. The lock arm 92L includes the first portion 921 positioned relative to the supports 92M in the mounting direction A, and the second portion 922 positioned in the direction B opposite to the connecting direction.

The first portion 921 includes the hooks 92A and 92B, and the second portion 922 includes the finger depressing portion 92F. The first portion 921 is formed with opposed relief portions 92C and 92D (see FIG. 9), which correspond to sides of the supports 92M in the connecting direction A. Corresponding portions of the outer surface to the relief portions 92C and 92D can be formed with a main die, which moves in a direction perpendicular to the outer surface.

FIG. 11 is a perspective sketch drawing showing a lock mechanism having a lock arm on an outer wall of a conventional connector shown in JP-A-2000-164294. Also, FIG. 12 is a vertical, cross sectional view corresponding to FIG. 11.

A lock mechanism 100 having a typical lock arm 101 shown in FIG. 11 is provided on an outer wall of a plug housing. The lock arm 101 has its fulcrum portion elastically supported by a pair of supports 103 and 104, which are formed on the outer wall of the plug housing to project therefrom, to be capable of swinging displacement.

A forward portion 10F of the lock arm 101 is formed in a manner that the arm projects toward a mating receptacle when the plug is to be connected to the receptacle and the forward portion 10F includes a saw-toothed hook 102. On the other hand, a backward portion 10R of the lock arm 101 is formed with a finger depressing portion 105, which makes a point of pressure.

The typical lock arm 101 shown in FIG. 11 is formed with a forward slide metal mold 91F and a backward slide metal mold 92R, which are arranged in opposition to each other. The forward slide metal mold 91F is moved in a direction (a direction indicated by an arrow A in the figure), in which a mating receptacle is inserted, and the backward slide metal mold 92R is moved in a direction (a direction indicated by an arrow B in the figure) opposite to the direction, in which the mating receptacle is inserted, so that the forward slide metal mold 91F and the backward slide metal mold 92R are combined together to mold the lock arm 101.

As shown in FIG. 12, the forward portion 10F of the lock arm 101 is mainly formed by means of the forward slide metal mold 91F, and the backward portion 10R of the lock arm 101 is mainly formed by means of the backward slide metal mold 92R.

As shown in FIG. 12, however, a backward portion of the hook 102 is formed by means of a portion R1 formed on the backward slide metal mold 92R to project therefrom. The portion R1 extends between the pair of supports 103 and 104 to form the backward portion of the hook 102. On the other hand, a forward portion of the hook 102 is formed by means of a recess F1 formed on the forward side metal mold 91F.

Also, as shown in FIG. 11, forward portions of the pair of supports 103 and 104 are formed by means of a bifurcate portion F2, which is formed on the forward slide metal mold 91F to project therefrom. On the other hand, backward portions of the pair of supports 103 and 104 are formed by means of portions R2 formed on both sides of the portion R1 of the backward slide metal mold 92R.

Since the lock arm 101 formed by means of the forward slide metal mold 91F and the rear slide metal mold 92R is blocked by the pair of supports 103 and 104 as shown in FIG. 11, a transverse width W of the hook 102 is made smaller than a whole transverse width of the lock arm 101.

Such a lock arm having a hook of a narrow lateral width may cause an incomplete coupling state with a latch formed on a mating receptacle. Thus, there has been desired a lock mechanism having a lock arm, which is formed by means of a forward slide metal mold and a backward slide metal mold and has a wide hook, and/or a connector with such lock mechanism.

SUMMARY OF THE INVENTION

It is an object of the present invention to provide a connector with a lock arm having a wide hook and being formed with a forward slide metal mold and a backward slide metal mold, and a connector with a lock mechanism, which includes such lock arm.

For the object, a structure is provided, in which a fulcrum portion of the lock arm is supported on both lateral ends thereof with columnar-shaped torque rods and the following novel plug with a lock mechanism is provided.

(1) A connector with a lock mechanism being provided on an outer surface of a connector body to hold connection with a mating connector, wherein the lock mechanism comprises a pair of supports projecting from the outer surface of the connector body and a lock arm including a fulcrum portion and a hook, the fulcrum portion being supported at lateral ends by a pair of torque rods such that the hook swings around the fulcrum portion, said pair of torque rods being joined to the said pair of supports; wherein said lock arm comprises a forward portion positioned forward from a turn center of said pair of torque rods in a connecting direction with the mating connector, and a backward portion positioned backward from the turn center of said pair of torque rods in a connecting direction with the mating connector; wherein the forward portion is provided with the hook to be latched on a latch being provided on the mating connector and the backward portion is provided with a finger depressing portion as a point of pressure; wherein a front face of the hook provided on the forward portion of said lock arm is open in a direction of connection to the mating connector and a latch face of the hook is open in a direction opposite to the direction of connection to the mating connector, without being blocked by the pair of torque rods; and wherein the latch face of the hook has a same latch width as a lateral width of the lock arm.

(2) The connector with the lock mechanism according to (1), wherein the hook is divided into two parts by a groove in the direction of connection to the mating connector.

(3) The connector with the lock mechanism according to (1) or (2), wherein the hook is further provided on lateral sides of the hook with a pair of notches so as to facilitate insertion of the hook into the latch provided on the mating connector.

In an aspect described in (1), the connector with a lock mechanism comprises, on an outer surface of a connector body, a lock mechanism that maintains a state of connection with a mating connector. Here, the lock mechanism comprises a pair of supports formed on an outer surface of the connector body to project therefrom, and a lock arm, of which a fulcrum portion is supported at both lateral ends (or side faces) thereof by a pair of torque rods so that a hook swings, the pair of torque rods being Joined to the pair of supports. The lock arm comprises a forward portion positioned relative to a center of rotation (or a turn center) of the pair of torque rods in a direction of mounting to the mating connector, and a backward portion positioned relative to the center of rotation of the pair of torque rods in a direction opposite to the direction of connecting to the mating connector. The forward portion comprises a hook being latched on a latch provided on the mating connector. Also, the backward portion comprises a finger depressing portion that makes a point of pressure. A front face of the hook on the forward portion is open (or exposed) in the direction of mounting to the mating connector. A latch face of the hook is open (or exposed) in the direction opposite to the direction of connecting to the mating connector, without being blocked by the pair of torque rods. A latch face of the hook has the same latch width as a lateral width of the lock arm.

In an aspect described in (1), the connector with a lock mechanism comprises, on an outer surface of a connector body, a lock mechanism that maintains a state of connection to a mating connector. The lock mechanism comprises a pair of supports formed on the outer surface of the connector body to project therefrom, and a lock arm, of which a fulcrum portion is supported at both lateral ends thereof by a pair of torque rods so that a hook swings, the pair of torque rods being Joined to the pair of supports. Here, the lock arm comprises a forward portion positioned in front relative to a center of rotation of the pair of torque rods in a direction of connecting to the mating connector, and a backward portion positioned in back relative to the center of rotation of the pair of torque rods in a direction opposite to the direction of connecting to the mating connector. The forward portion comprises a hook being latched on a latch provided on the mating connector. The backward portion comprises a finger depressing portion that makes a point of pressure. A front face of the hock on the forward portion is open (or exposed) in the direction of connecting to the mating connector. A latch face of the hook opposite to the front face is also open in the direction opposite to the direction of connecting to the mating connector, without being blocked by the pair of torque rods. A bottom surface of the lock arm being opposed to the outer surface of the connector body extends from the latch face in a direction opposite to the direction of connecting to the mating connector in a substantially flat manner. The latch face of the hook has substantially the same latch width as a lateral width of the lock arm.

The lock mechanism including a lock arm provided on the outer surface of the connector body may be arranged in pair on both sides of the connector body in an opposed manner. Also, a single lock mechanism may be arranged on the outer surface of the connector body.

The mating connector may comprise a rectangular connector mounted to an apparatus, which includes a panel. The mating connector may comprise a rectangular connector for a printed circuit board such that the connector is mounted to the printed circuit board. In another aspect according to the present invention, the connector connected to a mating connector may comprise a rectangular connector with cables. The cables may comprise a flat cable.

In another aspect according to the present invention, the connector may comprise a shell-type multipolar plug. A mating connector may comprise a shell-type multipolar receptacle. Female contacts are usually inserted into a shell-type multipolar plug. Then, male contacts are inserted into a mating shell-type multipolar receptacle. However, male contacts may be inserted into a plug and female contacts may be inserted into a receptacle.

The lock arm may include a hook, a swinging front end of which is formed to be saw-toothed in shape. The hook is latched on and engaged by a mountainous projecting latch whereby the connector and the mating connector lock together.

The torque rods supporting a fulcrum portion of the lock arm at both lateral ends thereof are subject to an exerted twisting torque, and the torque rods may comprise hollow tubes. Also, the torque rods are not limited to round bars (column). The torque rods may comprise a bulged column, an approximate column, a rectangular column, and a column with a notch in an arcuate shape.

The pair of supports may be formed to project in a rectangular-parallelepiped shape from the outer surface of the housing, or formed to project in a trapezoidal manner such that a lower portion is wider than an upper portion. Also, the pair of supports may be formed to project in a flanged manner such that they are made flush with the outer surface of the connector body.

In yet another aspect according to the present invention, the front face of the hook on the forward portion of the lock arm is open in the direction of connecting to the mating connector. The latch face of the hook is also open in a direction opposite to the direction of connecting to the mating connector, without being blocked by the pair of torque rods. Further, the bottom surface of the lock arm opposed to the outer surface of the connector body extends from the latch face in the direction opposite to the direction of connecting to the mating connector in a substantially flat manner. Accordingly, the hook formed to be saw-toothed in shape can be formed wide with a forward slide metal mold and a backward slide metal mold.

In yet another aspect according to the present invention, there is provided a lock arm formed with a forward slide metal mold and a backward slide metal mold and a hook provided on the lock arm may have the same latch width as a lateral width of the lock arm as opposed to a conventional hook having a smaller width. Such lock arm may make it sure that the hook couples with a latch formed on a mating connector.

In yet another aspect according to the present invention, the connector body, the lock arm, the pair of torque rods, the pair of supports, and the hook are made integrally with an insulating synthetic resin, and the connector can be formed with a forward slide metal mold and a backward slide metal mold. Accordingly, the structure may be easy to form, which does not need many metal dies.

According to the description of (2), in the connector with a lock mechanism according to (1), the hook provided on the forward portion may be divided into a pair of parts by a groove extending in the direction of connecting to the mating connector.

According to the preferred embodiment, a latch face of the hook being latched on and engaged with a latch formed on a mating connector is divided. Accordingly, even when a direction of engagement of the hook is slightly inclined relative to a direction of connection of the connector, the pair of mutually independent portions thereof can be elastically deformed to fit on the latch. Accordingly, it is likely that locking may be sure.

According to the description (3), in the connector with a lock mechanism according to either (1) or (2), the hook provided on the forward portion may be provided on both lateral sides of the hook with a pair of notches so as to facilitate insertion into a latch provided on a mating connector.

According to the preferred embodiment, the pair of notches are provided on the both lateral sides of the hook so as to facilitate insertion of the hook into the latch formed concavely on a mating connector such that the hook is inserted into the latch with some clearance in a lateral direction. The pair of notches may comprise a triangular notch formed with a slope, which may have a wider bottom and a narrower top, or a triangular notch formed with a slope, which becomes wider rearward from a front end of the hook. With the former, the hook is in the form of an inverse trapezoid as viewed from the front, and with the latter, the hook is in the form of an inverse trapezoid as viewed from the bottom.

In a connector with a lock mechanism according to the present invention, as a preferred embodiment, the lock mechanism having the pair of torque rods supporting the lock arm at both lateral ends thereof so that the hook having the same latch width as a lateral width of the lock arm swings may be provided on both sides surfaces (said to be both lateral ends) of the plug housing.

Also, in the connector with a lock mechanism according to the present invention, as a further preferred embodiment, the lock mechanism having the pair of torque rods supporting the lock arm at both lateral ends thereof so that the hook having the same latch width as a lateral width of the lock arm swings may be provided on an outer surface of the connector body.

The torque rods that constitute the lock mechanism according to the present invention may comprise a simple column, which can be formed easily with a forward slide metal mold and a backward slide metal mold, and the torque rods can be formed as a bulged column in order to avoid stress concentration, which may be generated on the torque rods. In addition, the bulged column does not mean a state, in which a column is expanded, but a shape of a buckled column.

Also, as a further preferred embodiment, in order to make a connector small in height or size, the torque rods may be in the form of a nearly elliptical column, or may be in the form of a column, which is cut off arcuately so as to be made flush with an upper surface of the lock arm.

With the connector with a lock mechanism, according to the present invention, which is made of an insulating synthetic resin, the connector body along with the lock mechanism may be made of polybutylene terephthalate (referred below to as PBT).

Since PBT has a high melting point and a high degree of crystallinity and a low absorption coefficient in water and a low thermal expansion coefficient, it may exhibit an excellent dimensional stability. Also, PBT has a feature to be excellent in electric insulation, small in change in electric characteristics due to moisture adsorption, and high in dielectric breakdown voltage.

In the connector with a lock mechanism according to the present invention, it is possible to form the hook having at least the same latch width as a lateral width of the lock arm, which is formed with a forward slide metal mold and a backward slide metal mold. Accordingly, a state of coupling with a latch formed on a mating connector may be reliably sure.

(4) An integrally formed lock structure capable of locking by engagement with a latch separate from the integrally formed lock structure, comprising: a lock arm comprising a hook provided in a vicinity of a front end in a direction of engagement with the latch and a rear end in a direction opposite to the direction of engagement; a pair of torque rods projecting in opposing lateral directions from a fulcrum portion positioned between the front end and the rear end of the lock arm: and a pair of supports to which respective projecting tip ends of the pair of torque rods are joined, wherein the pair of torque rods supported by the pair of supports are twisted elastically such that the lock arm is turned around a fulcrum portion, wherein as the lock arm is moved in the direction of engagement, the pair of torque rods are twisted elastically such that the hook rides over the latch to a position engageable with the latch such that the elastically twisted pair of torque rods are released at least partially so as to enable the hook to engage with the latch; wherein the pair of torque rods are twisted elastically by force applied on the rear end so as to turn the lock arm around the fulcrum portions such that the hook is disengaged from the latch, and wherein the lock arm is moved in the direction opposite to the direction of engagement such that the hook is released from the latch.

(5) The integrally formed lock structure according to (4), wherein the lock arm is formed in a substantially rectangular parallelepiped defined by an upper surface, a lower surface, left and right side surfaces, a front surface, and a rear end surface, wherein the hook is integrally formed in the vicinity of the front end and on the lower surface of the rectangular parallelepiped such that the hook comprises a slope formed in a wedge shape in a lateral view of the hook and a latch face substantially perpendicular to the lower surface, the latch face being formed from an end of the slope, wherein the torque rods are integrally formed so as to project from the fulcrum portion on the left and right side surfaces, respectively; and wherein the pair of supports support the pair of torque rods such that sufficient clearances are provided above the upper surface and below the lower surface to enable the lock arm to turn about the torque rods.

(6) The integrally formed lock structure according to (4) or (5), wherein the integrally formed lock structure can be formed with a combination of a forward slide mold and a backward slide mold by sliding the molds in parallel to the direction of engagement.

(7) The integrally formed lock structure according to any one from (4) to (6), wherein outer surfaces of the integrally formed lock structure essentially consist of surfaces parallel to the direction of engagement, simple slope surfaces, and convex surfaces with respect to the direction of engagement.

(8) A lockable connector provided on both side surfaces thereof with the integrally formed lock structure according to any one from (4) to (6).

The integrally formed lock structure may be a structure of lock formed integrally. Injection molding and any other molding means can be adapted to the integral forming. Also, a latch separated from the integrally formed lock structure may be a member or the like, which is separated from the lock structure and can engage with the lock structure. For example, in a connector pair comprising a plug and a receptacle/connector, a latch may be provided on the plug and a lock mechanism may be provided on the receptacle/connector, or vice versa. The latch may assume a wedge shape in a lateral view or in a cross-section view. The wedge-shaped slope may comprise a guide surface for guiding the hook in engagement of the hook. The wedge-shaped portion may form a vertical wall at the rear end, or the wall may have a slope inclined somewhat from the vertical line. The direction of engagement may be a direction in which the integrally formed lock structure approaches the latch. More concretely, such direction may be a direction, in which a front end of the lock arm rides over the latch. The hook at the front end usually slides on the slope, which constitutes a guide surface of the latch, at the time of movement in the direction of engagement to turn the lock arm in a manner to twist the pair of torque rods. Opposing lateral directions may mean directions extending outward from the sides (or lateral ends) of the lock arm. Since the lock arm may usually be in the form of a substantially rectangular parallelepiped, the pair of torque rods project in mutually opposing directions. The pair of torque rods are arranged in opposite positions on the left and right sides of the lock arm. The supports may comprise members to support the pair of torque rods. More concretely, the supports can be made in the form of vertically upright walls. The form comprises a form which does not to block displacement of the lock arm. The pair of supports are not necessarily made symmetric with respect to each other. Turning of the lock arm around a fulcrum portion may include movements of the lock arm like a seesaw about a fulcrum portion thereof. Movement in the opposite direction to the direction of engagement may mean that the lock mechanism is completely released from engagement with the latch at the time of movement in a state, in which engagement of the latch and the hook is released. Also, when such lock mechanisms are symmetrically arranged on both sides of the connector, they enable turning the lock arm in a direction of release in response to clenching of the connector.

DESCRIPTION OF THE PREFERRED EMBODIMENT

The preferred embodiment of the present invention will be described below in reference to the drawings. However, the present invention is not limited to the embodiment, and various modifications and changes in design can be made without departing from the scope of the present invention.

Figure 1:
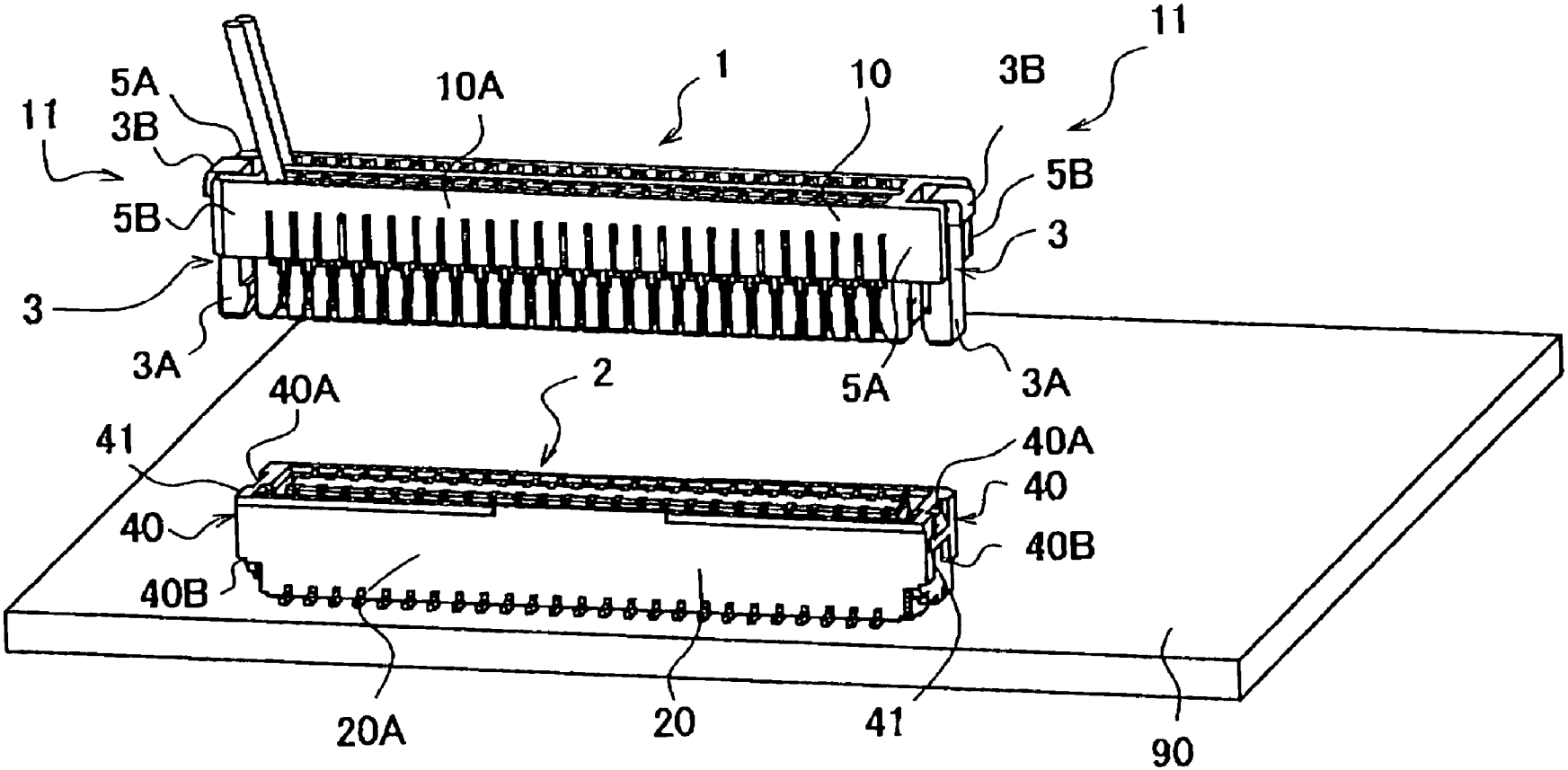
FIG. 1 is a perspective view showing a connector with a lock mechanism according to an embodiment of the present invention, and a mating connector, to which the connector is connected.

FIG. 1 is a perspective view showing a connector with a lock mechanism and a mating connector, to which the connector is connected according to an embodiment of the present invention. In FIG. 1, the reference numerals 1, 2, and 11 denote a plug for a connector, a receptacle for a mating connector, and a lock mechanism according to the present invention.

In the embodiment shown in FIG. 1, the plug 1 indicates a shell-type multipolar, rectangular connector. A plug housing 10 constituting a connector body, an outer shell of which is made of an insulating synthetic resin to be rectangular in shape, includes a rectangular-shaped plug frame 10A being inserted into a mating receptacle. The plug housing 10 is provided with a plurality of plate-shaped contacts with cables.

On the other hand, a receptacle 2 constituting a mating connector appears in a shell-type multipolar rectangular connector and the receptacle 2 may be a connector for a printed circuit board so as to be surface-mounted to the printed circuit board 90. A receptacle housing 20, an outer shell of which is made of an insulating synthetic resin to be rectangular in shape, includes a frame 20A formed with a recess, into which the plug 1 is inserted. The receptacle housing 20 is provided with a plurality of plate-shaped contacts, which are to couple with plate-shaped contacts fixed to the plug 1.

In the embodiment shown in FIG. 1, the lock mechanisms 11 includes a lock arm 3 provided on an outer wall (or surface) of the plug housing 10. The lock arm 3 comprises a hook 3A positioned in a direction, in which the lock arm 3 is engaged with the receptacle 2 and latched on the receptacle 2. A point of pressure 3B comprises a finger depressing portion positioned in a direction opposed to the direction of connection to the receptacle 2. A fulcrum portion 3C described later is positioned between the hook 3A and the point of pressure 3B.

In the embodiment shown in FIG. 1, the lock arm 3 comprise the hook 3A, the point of pressure 3B, and the fulcrum portion 3C described later. The lock arm 3 has the fulcrum portion 3C and is supported at both lateral ends of the fulcrum portion 3C by a pair of torque rods 4A and 4B so that the hook 3A swings as described later.

In the embodiment shown in FIG. 1, the plug housing 10 comprises a pair of supports 5A and 5B. The pair of supports 5A and 5B project from the outer wall (or surface) of the plug housing 10 and are provided on both sides of the plug housing 10. The pair of supports 5A and 5B are joined to the pair of torque rods 4A and 4B, which support the lock arm 3 at both lateral ends thereof as described later.

In FIG. 1, the plug housing 10, the lock arms 3, the pair of torque rods 4A and 4B described later, and the pair of supports 5A and 5B are made integrally of an insulating synthetic resin, for example, PBT or the like.

On the other hand, in the embodiment shown in FIG. 1, the receptacle 2 comprises latches 40. Since the lock arms 3 are latched on the latches 40, a state, in which the plug 1 and the receptacle 2 are engaged together, is maintained.

In the embodiment shown in FIG. 1, the latches 40 are provided on an outer wall of the receptacle housing 20. The latches 40 comprise guides 40A being open in a direction, in which the plug 1 is connected. Latches 40B are positioned in opposition to the guides 40A and formed into a thin, rectangular-shaped recess.

In FIG. 1, when the plug 1 is moved in the direction of connecting in order to connect the plug 1 to the receptacle 2, slopes 41 (see FIG. 3) formed on the guides 40A slide on and ride over slopes 31 (see FIG. 3) formed on the saw-toothed hooks 3A, so that the hooks 3A are opened outward about the fulcrum portions 3C as centers of rotation as described later.

When the plug 1 is further moved in the direction of connection, elastic returning force of the pair of torque rods 4A and 4B cause the hooks 3A to sink in the latches 40B, so that a state, in which the plug 1 and the receptacle 2 are engaged together, is maintained.

Figure 2:
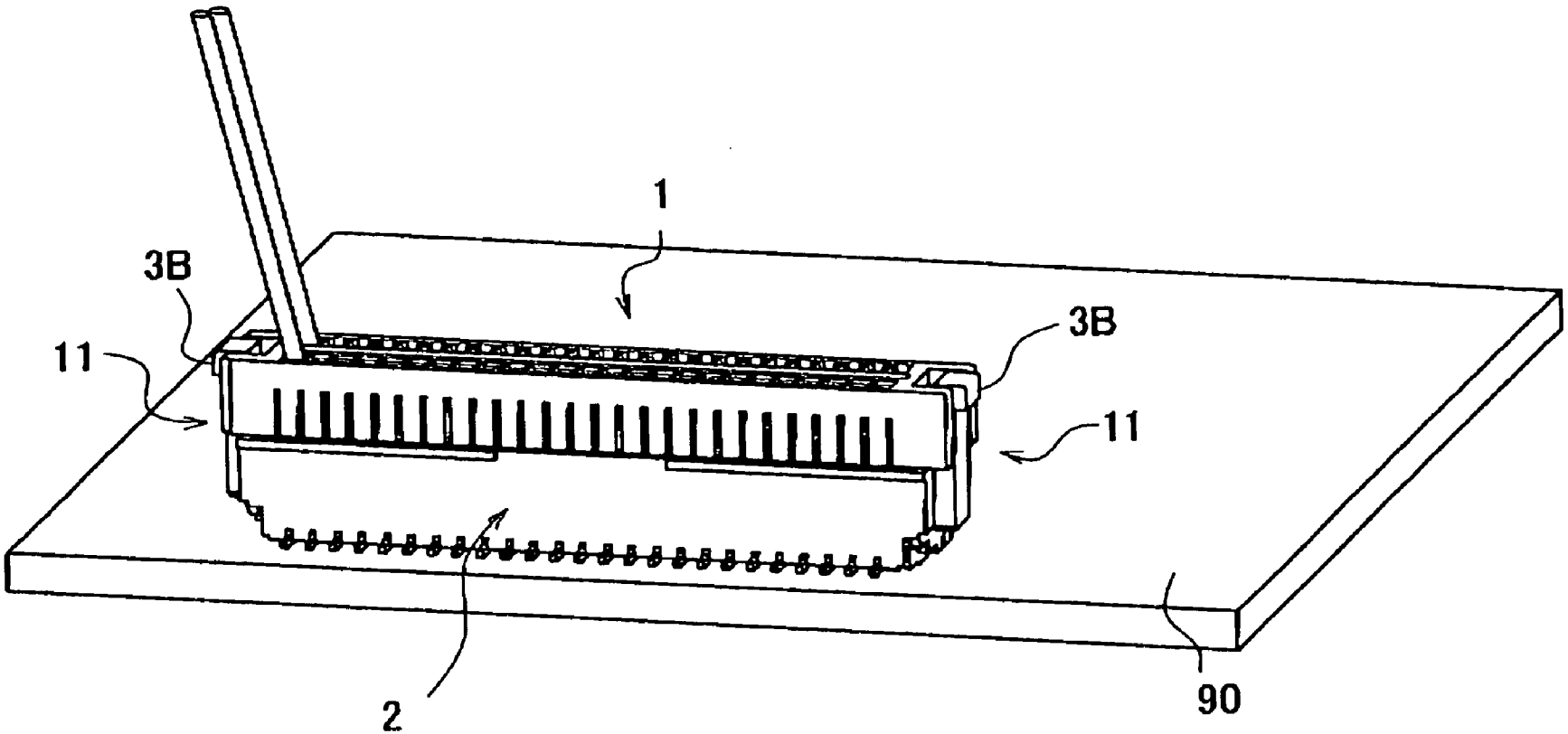
FIG. 2 is a perspective view showing a plug and a receptacle, according to the embodiment of the present invention as the plug is connected to the receptacle.

FIG. 2 is a perspective sketch view showing the plug 1 and the receptacle 2 in a state in which the receptacle 2 is connected to the plug 1 according to the present invention.

In the embodiment shown in FIG. 2, a state, in which the plug 1 and the receptacle 2 are engaged together, can be released by pushing the points of pressure 3B, which may be finger depressing portions, and moving the plug 1 in a direction opposed to the direction of connection in a state, in which the hooks 3A are opened outward about the fulcrum portions 3C as centers of rotation as described later.

Figure 3:
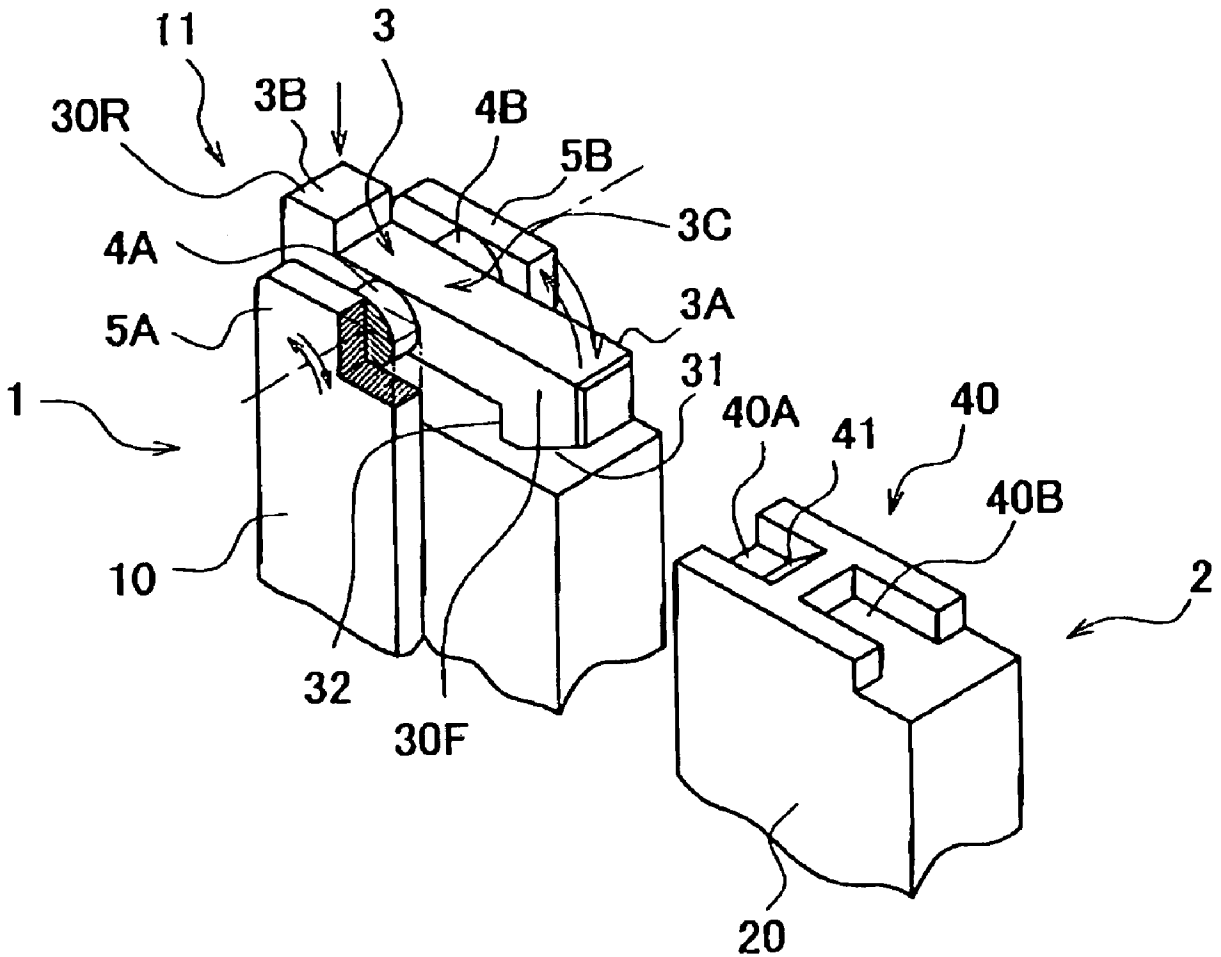
FIG. 3 is a perspective view showing main parts of the plug 1 and the receptacle 2 in an enlarged scale according to the embodiment of the present invention.

The operation of the lock mechanisms according to the present invention will be described below with reference to FIG. 3. FIG. 3 is a perspective view showing main parts of the plug 1 and the receptacle 2 shown in FIG. 1 in an enlarged scale according to the present invention. In addition, in the illustration of FIG. 3, details are omitted for the purpose of explaining the operation such that the pair of torque rods 4A and 4B performing as the fulcrum portions 3C are drawn with exaggeration.

In FIG. 3, the took mechanism 11 comprises the pair of supports 5A and 5B formed on the outer surfaces of the plug housing 10 forming a connector body such that the pair of supports 5A and 5B project therefrom. Also, the lock mechanism 11 comprises the lock arm 3. The lock arm 3 is supported by the pair of torque rods 4A and 4B fixed to the fulcrum portion 3C at both lateral ends thereof in such a manner to allow the hook 3A to swing. The pair of torque rods 4A and 4B are joined to the pair of supports 5A and 5B, respectively.

The lock arm 3 comprises a forward portion 30F positioned in front relative to the center of rotation of the pair of torque rods 4A and 4B in the direction of connecting to the receptacle 2, and a backward portion 30R positioned in back relative to the center of rotation of the pair of torque rods 4A and 4B in the direction opposite to the direction of connection to the receptacle 2. The forward portion 30F comprises the hook 3A being latched on the latch 40 provided on the receptacle 2, and the backward portion 30R comprises a finger depressing portion to perform as the point of pressure 3B.

Further, a front face of the hook 3A on the forward portion 3OF is open in the direction of connection to the receptacle 2, and a latch face 32 of the hook 3A is open in the direction opposite to the direction of connection to the receptacle 2, without being blocked by the pair of torque rods 4A and 4B. The latch face 32 of the hook 3A has the same latch width as a lateral width of the lock arm 3.

In the plug 1 according to the embodiment shown in FIG. 1, the lock mechanism 11 is arranged on both sides of the plug housing 10. On each side the mechanism 11 has the pair of torque rods 4A and 4B (see FIG. 3) supporting the lock arm 3 at both lateral ends thereof in such a manner that the hook 3A having the same latch width as the lateral width of the lock arm 3 may swing.

Further, with the plug 1 in the embodiment shown in FIG. 1, outer walls of the pair of supports 5A and 5B (see FIG. 3) joined to the pair of torque rods 4A and 4B supporting the lock arm 3 at both lateral ends thereof are flush with both side surfaces of the plug housing 10.

As shown in the embodiment of FIG. 3, the pair of supports 5A and 5B formed to extend continuously to and project from the both side surfaces of the plug housing 10 in a flanged manner make the both side surfaces of the plug housing 10 flat. By constituting the lock mechanisms according to the present invention in this manner, it is possible to make the plug small in size and height.

Likewise, with the receptacle 2 shown in the embodiment of FIG. 3, the latches 40 for engagement with the lock arm 3 are provided on both sides of the receptacle housing 20. In the receptacle 2 shown as the embodiment in FIG. 1, a pair of latches 40 are made flush with both side surfaces of the receptacle housing 20.

As shown in the embodiment of FIG. 1 or FIG. 3, the pair of latches 40 formed to extend continuously to and project from the both side surfaces of the receptacle housing 20 make the both side surfaces of the receptacle housing flat. By constituting the receptacle 2 in this manner, it is possible to make the receptacle small in size and height.

With the plug 1 and the receptacle 2 structured in this manner, a user clasps the points of pressure 3B, which perform as a pair of finger depressing portions provided on the lock mechanisms 11, in an engaged state shown in FIG. 2 and moves the plug 1 away from the receptacle 2.

In this manner, the connector with the lock mechanism according to the present invention may be made small in size and height and the hook may be provided to have at least the same width as the entire transverse (or lateral) width of the lock arm. Therefore, there may be produced an effect to make sure a state of engagement to latches formed on a mating connector.

Figure 4:
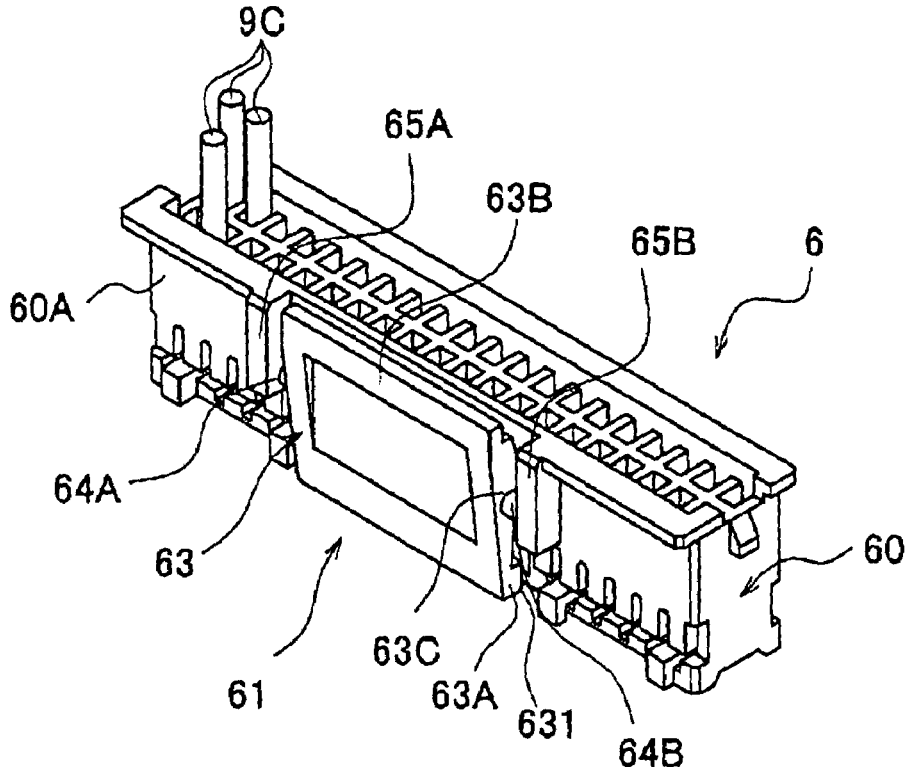
FIG. 4 is a perspective view showing a plug and a receptacle, according to another embodiment of the present invention, as the plug and the receptacle are separated from each other.
Figure 4:
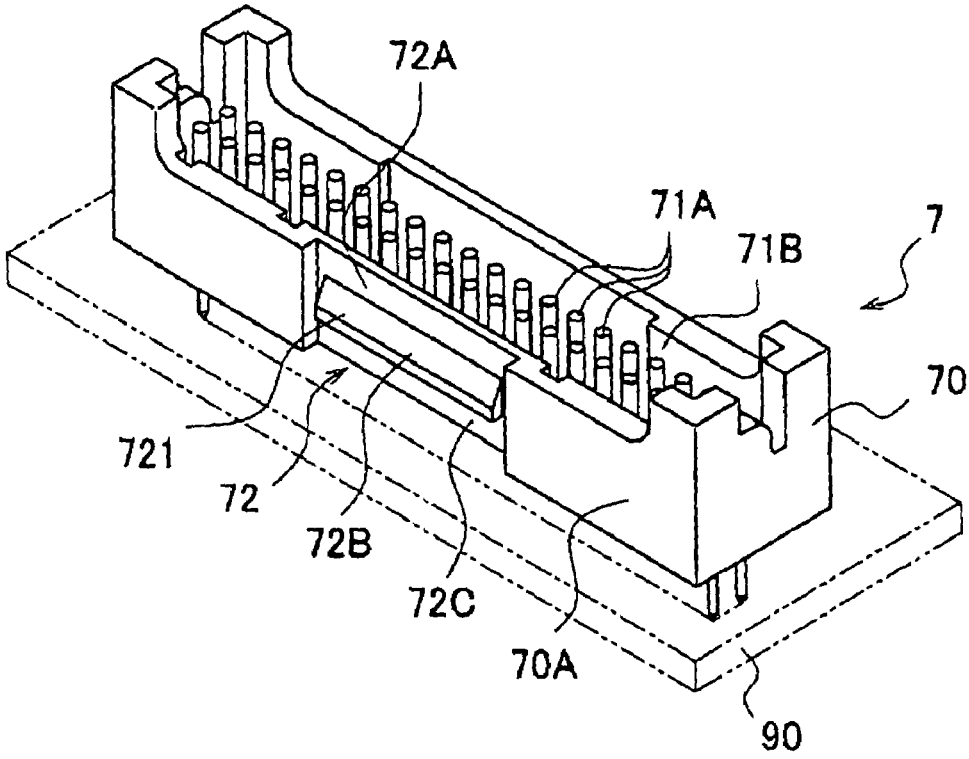

Subsequently, a further embodiment of a plug, which performs as a connector, to which the lock mechanism according to the present invention is applied, and a receptacle, which performs as a mating connector, will be described with reference to FIG. 4. FIG. 4 is a perspective view showing a plug 6 and a receptacle 7 in a state that the plug 8 and the receptacle 7 are separated from each other according to another embodiment of the present invention.

In FIG. 4, the receptacle 7 is fixed to a surface of a printed circuit board 90. Ends of a plurality of cables 9C arranged in parallel are fixed to the plug 6. The plug 6 is to be coupled with the receptacle 7.

The receptacle 7 comprises a receptacle housing 70 made of a synthetic resin and a plurality of terminals 71A. A receptacle housing 70, an outer shell of which is made of an insulating synthetic resin to be rectangular in shape, includes a plug frame 60A formed with a recess, into which the plug 6 is inserted. The plurality of terminals 71A extend through the receptacle housing 70 and are arranged in a transverse row. The terminals 71A projecting downwardly of the receptacle housing 71 are fixed at front ends thereof to the printed circuit board 90 by means of soldering.

The receptacle housing 70 is open at an end surface on a coupled side thereof and includes an insertion and extraction recess 71B to permit insertion and extraction of a part of a corresponding mating plug 6. The plurality of terminals 71A are aligned and arranged in the insertion and extraction recess 71B.

A mountainous engagement projection 72B is formed on an outer surface of the receptacle housing 70. The mountainous engagement projection 72B is latched on and engaged by a hook 63A of a lock mechanism 61 on a side of the plug 6.

The engagement projection 72B is formed in a recess 72C on the outer surface of the receptacle housing 70 to project therefrom. A guide 72A is provided forwardly of the engagement projection 72B to receive the hook 63A provided on the plug 6. The guide 72A, the engagement projection 72B, and the recess 72C constitute a latch 72 for engagement with a lock arm 63 provided on the plug 6.

On the other hand, a plug housing 60, an outer shell of which is made of an insulating synthetic resin to be rectangular in shape, includes a rectangular plug frame 50A for insertion into the mating receptacle 7. Provided on an outer surface of the plug housing 60 is the plate-shaped lock arm 63, which is arranged in parallel to the outer surface. A fulcrum portion 63C of the lock arm 63 is supported at both lateral ends thereof by a pair of supports 65A and 65B, which are formed on the outer surface to project therefrom.

The pair of supports 65A and 65B join a pair of torque rods 84A and 64B to the fulcrum portion 63C of the lock arm 63. The pair of torque rods 64A and 64B twist so that the hook 63A swings. A point of pressure 63B comprises a finger depressing portion positioned on an opposite side to the hook 63A.

In FIG. 4, the plug housing 60, the lock arm 63, the pair of torque rods 64A and 64B, and the pair of supports 65A and 65B are made integrally of an insulating synthetic resin, for example, PBT or the like. These elements constitute the lock mechanism 61.

In FIG. 4, when the plug 6 is moved in the direction of connection in order to connect the plug 6 to the receptacle 7, a slope 631 formed on a front end of the saw-toothed hook 63A slides on and rides over a slope 721 formed on the mountainous engagement projection 72B, so that the hook 63A is opened outward about the fulcrum portion 83C as a center of rotation.

When the plug 6 is further moved in the direction of connection, elastic returning force of the pair of torque rods 64A and 64B cause the hook 63A to be latched on the engagement projection 72B, so that a state, in which the plug 6 and the receptacle 7 are coupled together, is maintained.

A state, in which the plug 6 and the receptacle 7 are coupled together, can be released by pushing the point of pressure 63B, which performs as a finger depressing portion, and moving the plug 6 in a direction opposed to the direction of connection in a state, in which the hook 63A is opened outward about the fulcrum portion 63C as a center of rotation.

With the embodiment shown in FIG. 4, the hook 63A has at least the same latch width as a lateral width of the lock arm 63. The lock mechanism 81 supporting the lock arm 63 at both ends thereof by the pair of torque rods 64A and 64B so that the hook 63A swings is arranged on one of the longitudinal outer walls of the rectangular plug frame 60A.

Figure 5:
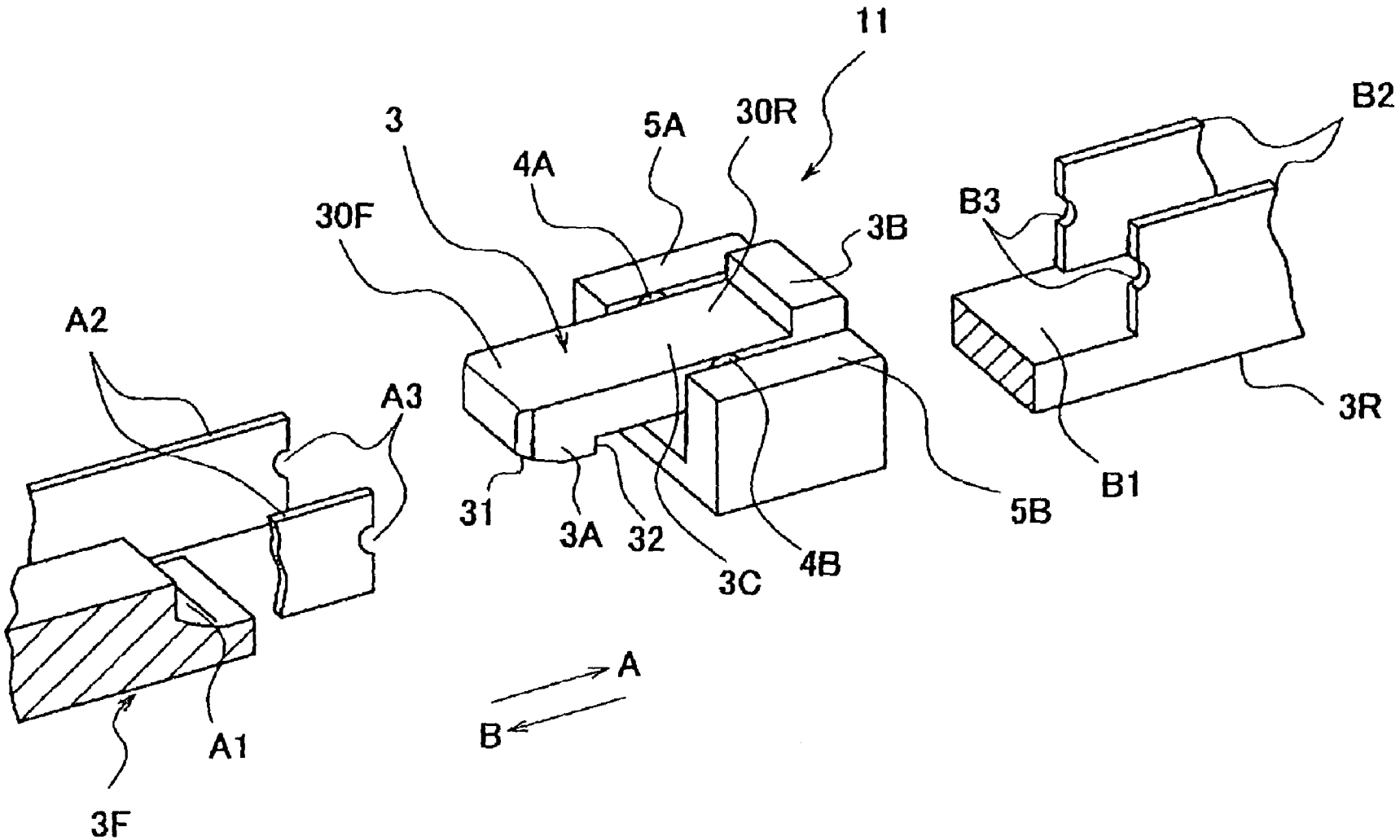
FIG. 5 is a perspective view showing the lock mechanism of the embodiment shown in FIG. 3 and a pair of metal molds that form the lock mechanism.

Subsequently, a constitution of metal molds to form the lock mechanism according to the present invention will be described with reference to FIGS. 5 and 6. FIG. 5 is a perspective view showing the lock mechanism 11 shown in the embodiment of FIG. 3 and a pair of metal molds to form the lock mechanism 11. Also, FIG. 6 is a vertical cross-sectional view of the embodiment shown in FIG. 5.

As shown in the embodiment of FIG. 5, the lock mechanism 11 is formed by means of a forward slide metal mold 3F and a backward slide metal mold 3R arranged in opposition thereto. The forward slide metal mold 3F is moved in a direction (a direction indicated by an arrow A in the figure), in which a mating receptacle 2 (see FIG. 1) is mounted, and the backward slide metal mold 3R is moved in a direction (a direction indicated by an arrow B in the figure) opposed to the direction, in which the mating receptacle 2 is connected, so that the forward slide metal mold 3F and the backward slide metal mold 3R are combined together to form the lock mechanism 11.

The forward portion 30F of the lock arm 3 positioned in front relative to the center of rotation of the pair of torque rods 4A and 4B in the direction of connection to the mating connector is formed by means of the forward slide metal mold 3F. The backward portion 30R of the lock arm 3 positioned in back relative to the center of rotation of the pair of torque rods 4A and 4B in the direction opposed to the direction of connection to the mating connector is formed by means of the backward slide metal mold 3R.

Figure 6:
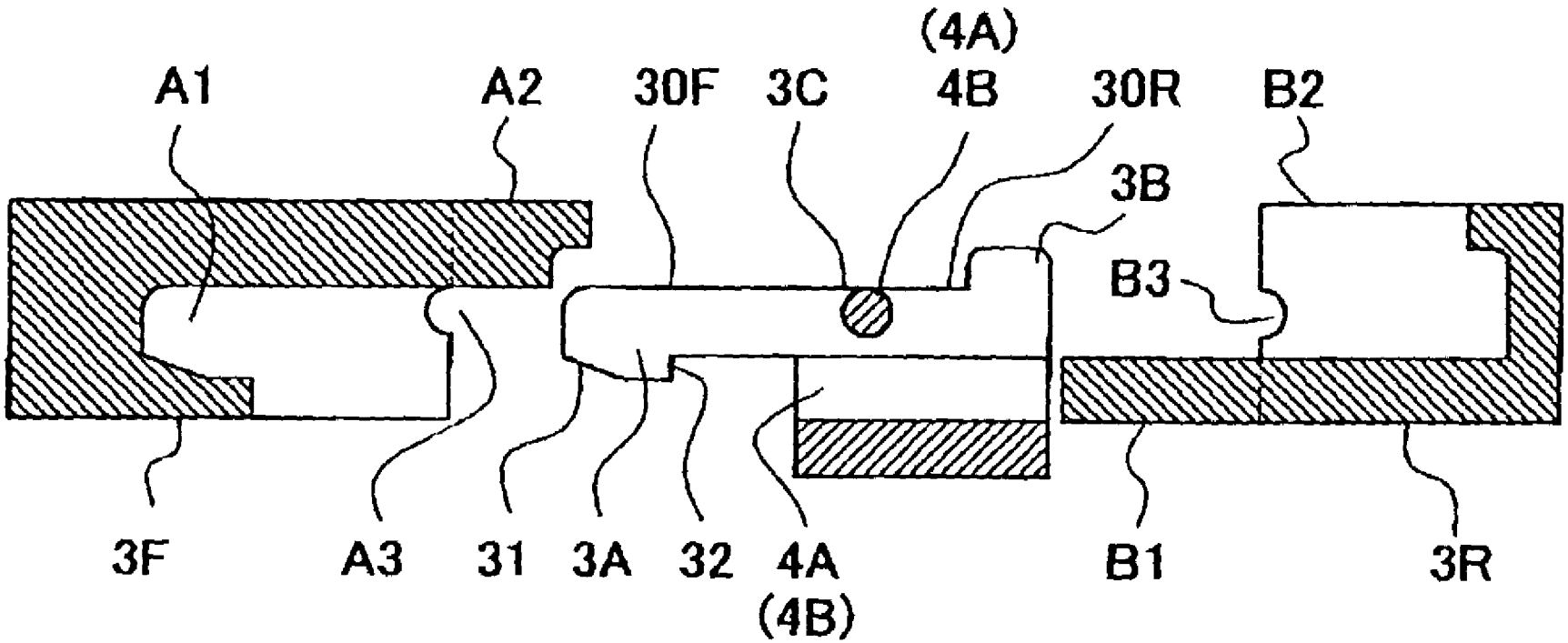
FIG. 6 is a vertical cross sectional view of the embodiment shown in FIG. 5.

As shown in the embodiment of FIG. 5 or FIG. 6, the forward portion 30F of the lock arm 3 including the hook 3A is formed by means of a portion Al formed concavely on the forward slide metal mold 3F. Both sides of the forward portion 30F of the lock arm 3 including the hook 3A are formed by means of portions A2, which are formed in a manner to surround both sides of the portion A1.

On the other hand, as shown in FIG. 5 or FIG. 6, the backward portion 30R of the lock arm 3 including the point of pressure 3B is formed by means of a portion B1, which is formed on the backward slide metal mold 3R to project therefrom. The portion B1 formed on the backward slide metal mold 3R to project therefrom is capable of forming a backward portion of the hook 3A. Both sides of the backward portion 30R of the lock arm 3 including the point of pressure 3B are formed by means of portions B2, which are formed in a manner to surround both sides of the portion B1.

Figure 8A:
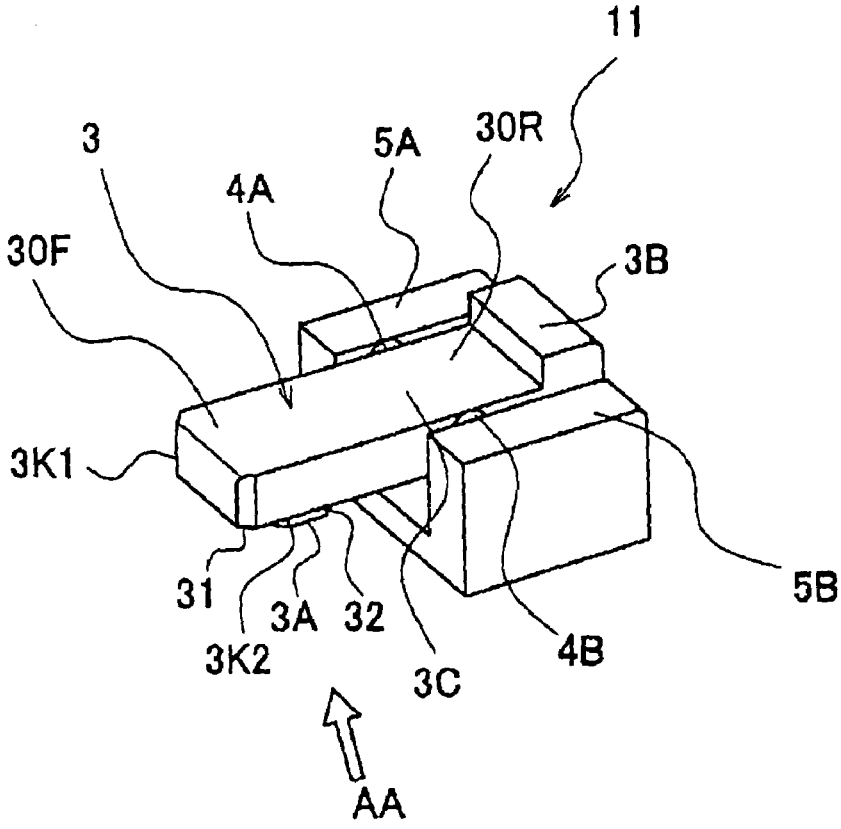
FIGS. 8A and 8B are perspective views showing a lock mechanism according to another embodiment of the present invention.
Figure 8B:
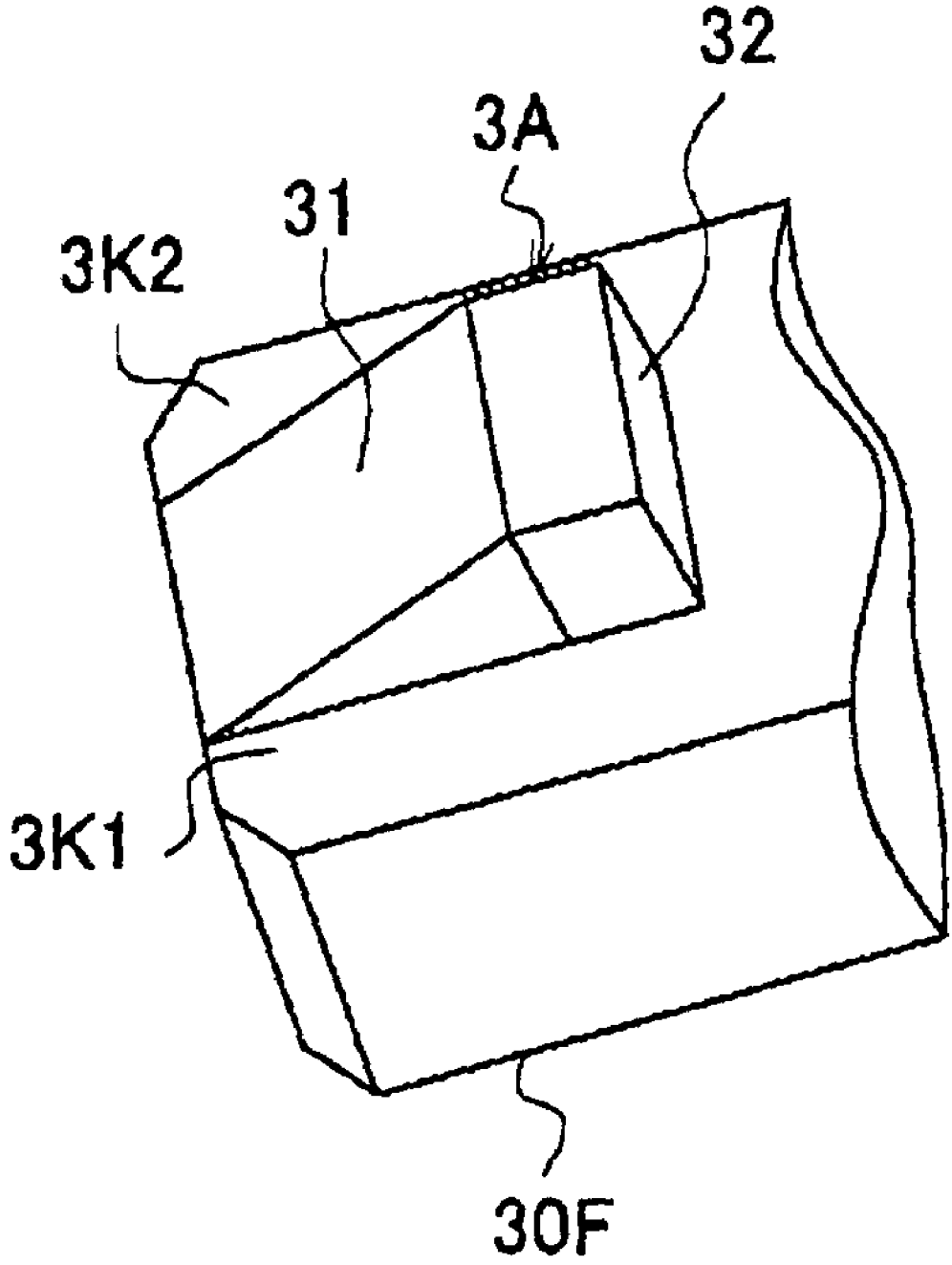
Figure 9:
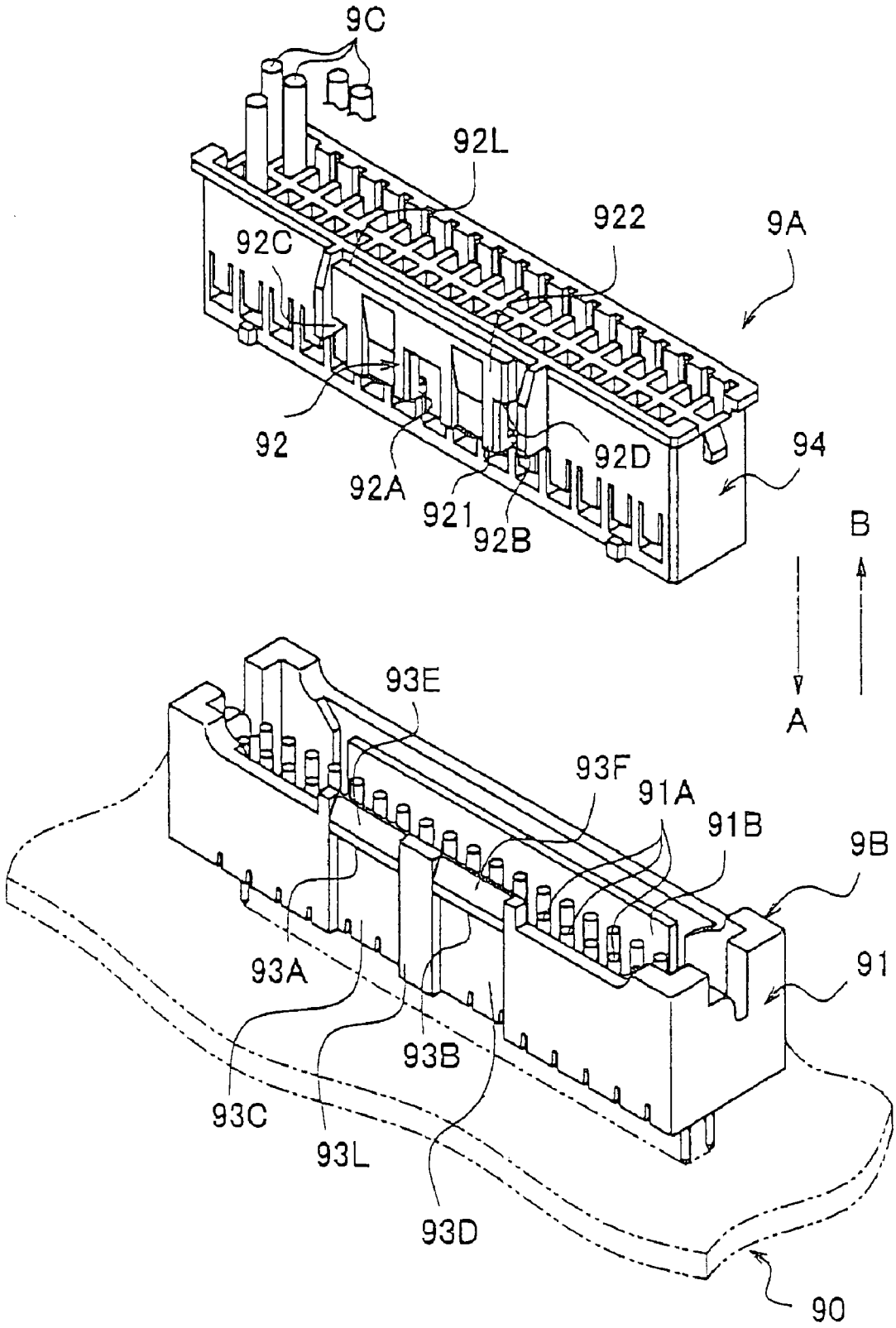
Fig. 9 PRIOR ART
FIG. 9 is a schematic perspective view showing a plug with a lock mechanism and a mating receptacle described in JP-A-2000-164294.
Figure 10:
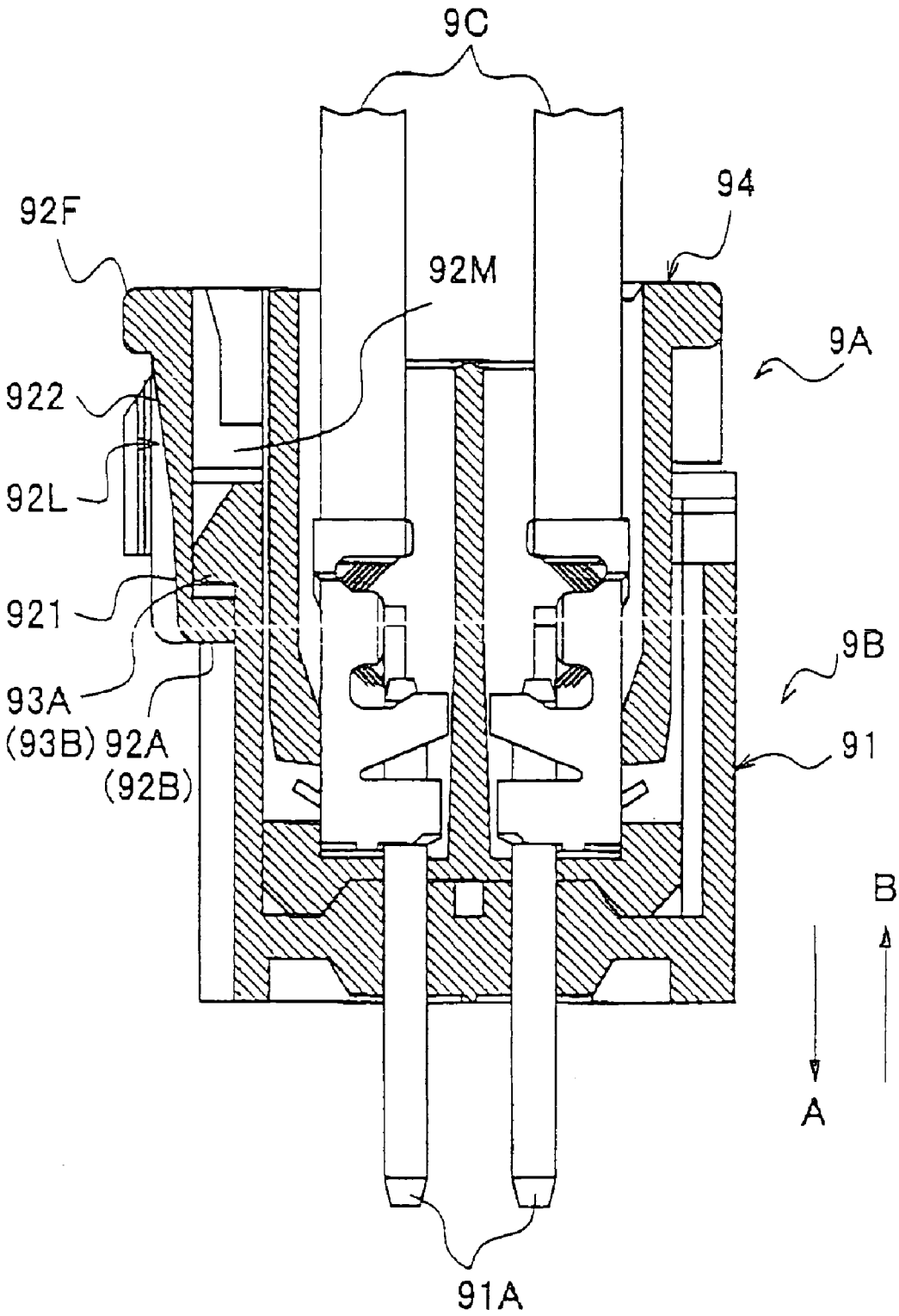
Fig. 10 PRIOR ART
FIG. 10 is a vertical cross sectional view showing both connectors in a coupled state as described in JP-A-2000-164294.
Figure 11:
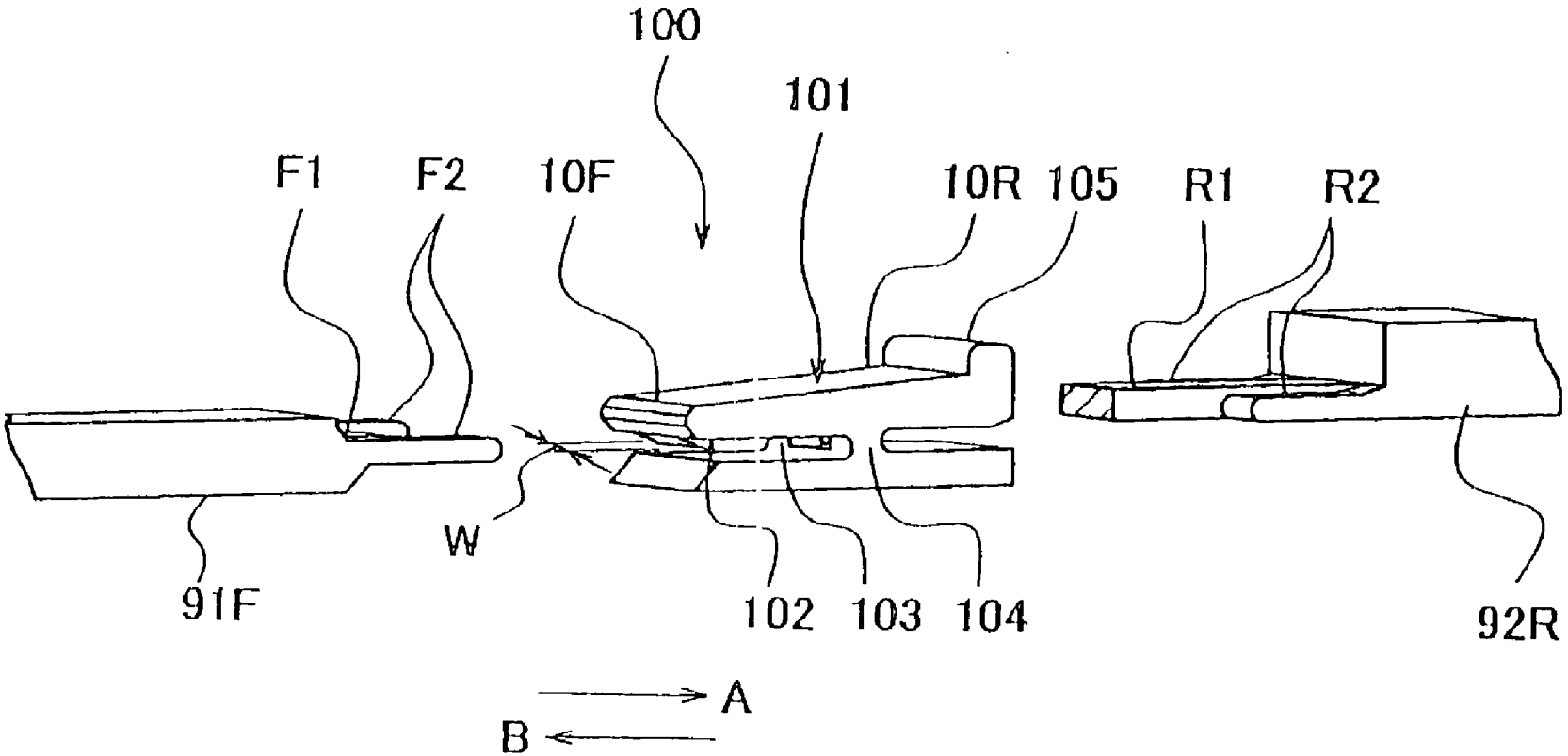
FIG. 11 is a perspective sketch view showing a lock mechanism including a lock arm provided on an outer surface of a conventional connector.
Figure 12:
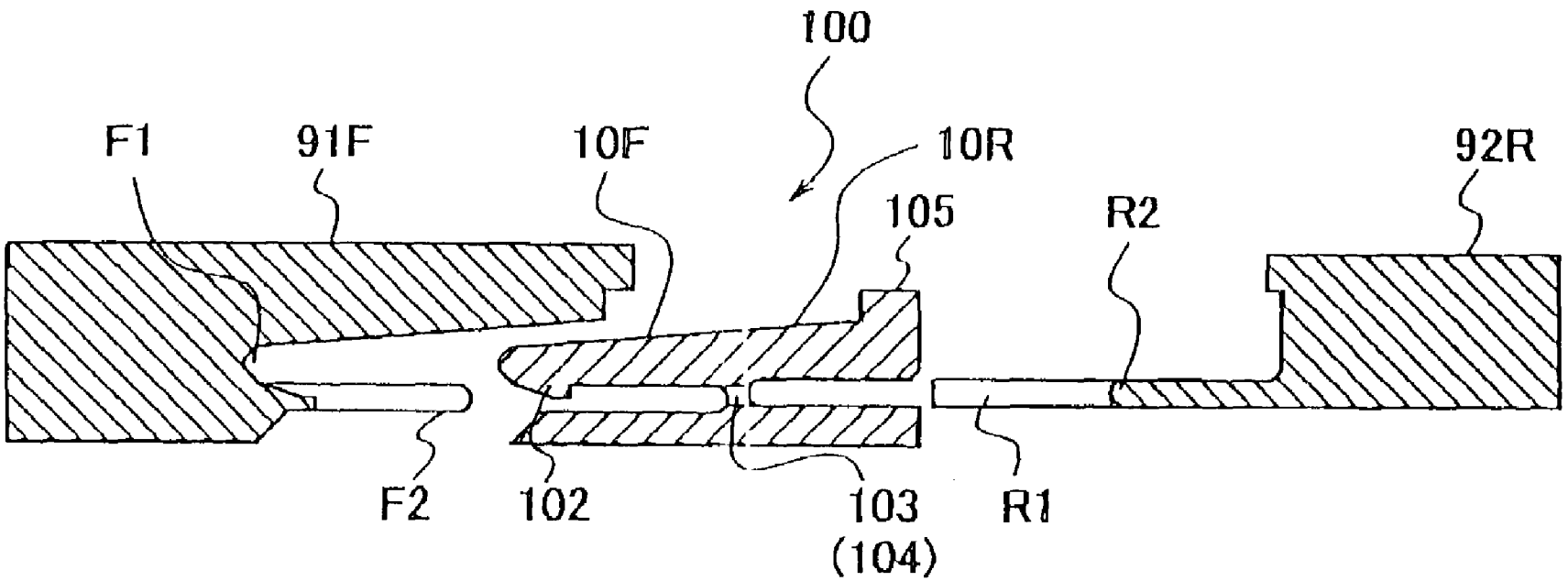
Fig. 12 PRIOR ART
FIG. 12 is a vertical cross-sectional view of the lock mechanism shown in FIG. 11.

Further, as shown in FIG. 5 or FIG. 8, the pair of portions A2 formed on the forward slide metal mold 3F to project therefrom are formed with semi-circular portions A3, respectively. The pair of portions B2 formed on the rear slide metal mold 3R are formed with semi-circular portions B3, respectively. The pair of semi-circular portions A3 and the pair of semi-circular portions B3 are combined together to form the pair of torque rods 4A and 4B.

In this manner, the lock arm and the pair of torque rods, which support the lock arm at both ends thereof, in the lock mechanism according to the present invention are formed by means of the forward slide metal mold and the backward slide metal mold, which are combined together.

Since the lock arm according to the present invention is structured such that a front face of the hook on the forward portion is open (or exposed) in the direction of mounting to the mating connector, and a latch face of the hook is open (or exposed) in the direction opposed to the direction of mounting to the mating connector, without being blocked by the pair of torque rods, a set of the forward slide metal mold and the backward slide metal mold can form the hook having at least the same latch width as a lateral width of the lock arm. The lock arm in the lock mechanism constructed in this manner produces an effect to make sure a state of coupling with a latch formed on a mating connector.

Figure 7:
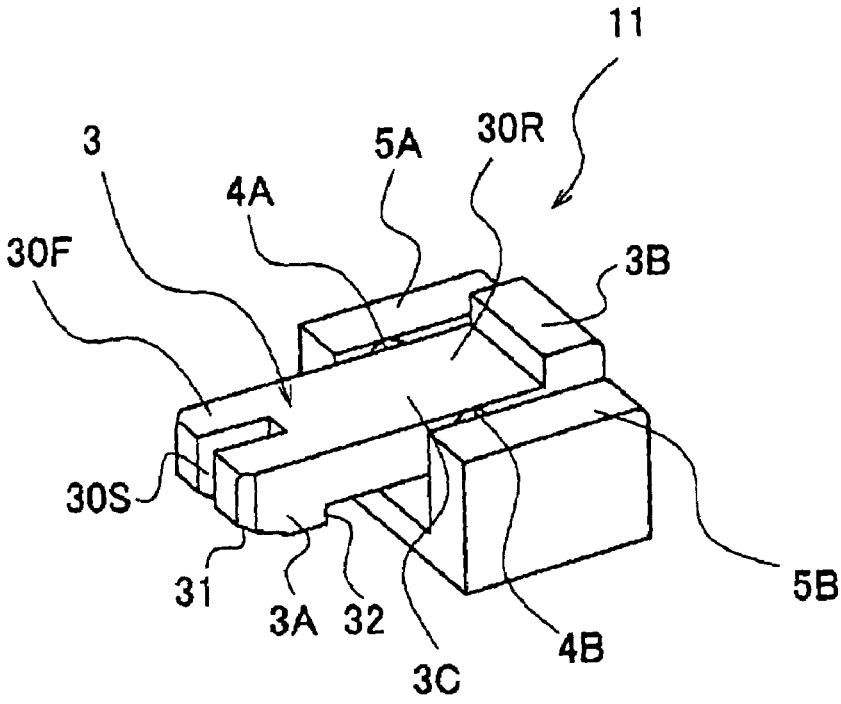
FIG. 7 is a perspective view showing a lock mechanism according to another embodiment of the present invention.

FIG. 7 is a perspective view showing a modification of the lock mechanism 11 shown in FIG. 5 according to the present invention. In the embodiment shown in FIG. 7, a hook 3A at a front end of a lock arm 3 is provided with a groove 30S, which extends in a direction of connecting to a mating connector. The hook 3A is divided into a pair of parts such that the groove 30S is interposed therebetween.

The groove 30S shown in FIG. 7 can be formed by partially changing the forward slide metal mold 3F shown in FIG. 5. While the hook 3A provided with such groove 30S is divided widthwise, it may be considered to have the same latch width as a lateral width of the lock arm 3, so that there is substantially the same effect of making sure a state of coupling with a latch formed on a mating connector.

Since the lock arm 3 according to a preferred embodiment shown in FIG. 7 produces an effect that even when a direction of connection of the hook 3A is slightly inclined relative to a direction of connection of the connector, the pair of mutually independent portions thereof are elastically deformed to fit the latch 40 (see FIG. 3) to make locking sure because the latch face 32 of the hook 3A being latched on and engaged by the latch 40 (see FIG. 3) formed on the mating connector is divided.

FIG. 8 is a perspective view showing a modification of the lock mechanism 11 shown in FIG. 5 according to the present invention. In the embodiment shown in FIG. 8, a hook 3A at 8 front end of a lock arm 3 is provided on both lateral sides thereof with a pair of notches 3K1 and 3K2 having a slight width.

The pair of notches 3K1 and 3K2 shown in FIG. 8 can be formed by partially changing the forward slide metal mold 3F and the backward slide metal mold 3R shown in FIG. 5. While the hook 3A provided on both lateral sides thereof with the pair of notches 3K1 and 3K2 having slight widths is decreased a magnitude, which corresponds to the notches, in a widthwise direction, it may be considered to have the same latch width as a lateral width of the lock arm 3, so that there is substantially the same effect of making sure a state of coupling with a latch formed on a mating connector.

The lock arm 3 according to a preferred embodiment shown in FIG. 8 comprises the pair of notches 3K1 and 3K2 provided on the both sides of the hook 3A so as to facilitate insertion into the latch 40 (see FIG. 3) formed concavely on a mating connector, thus insertion into the latch 40 is eased(see FIG. 3).

The pair of notches 3K1 and 3K2 may comprise triangular notches formed with a slope, which widens from a bottom surface of the hook 3A to a top surface thereof, or triangular notches formed with a slope, which widens rearward from a front end of the hook 3A. With the former, the hook 3A is in the form of an inverse trapezoid as viewed from the front, and with the latter, the hook 3A is in the form of an inverse trapezoid as viewed from the bottom.

According to the present invention, a connector with a lock mechanism being provided with a hook, which is easy to form and has a wide latch width, has been explained as a connector for electric connection. A plug with a lock mechanism, in which a lock arm having a hook with a wide engagement width is supported at both lateral ends thereof by torque rods, may be applied to an optical connector for connection of optical elements and optical fibers, and a mating optical connector according to the present invention.

What is claimed is:

1. A connector comprising:

a mating connector and a connector body to maintain connection with the mating connector;

the connector body comprising a lock mechanism, the lock mechanism comprising:

a pair of supports projecting from the outer surface of the connector body, and a lock arm including a fulcrum portion, a hook, and substantially cylindrical torque rods, the fulcrum portion being supported at lateral ends by the pair of substantially cylindrical torque rods such that the hook swings around the fulcrum portion, said pair of torque rods being joined to the pair of supports;

wherein said lock arm extends beyond the pair of supports and comprises a forward portion positioned forward from a turn center of said pair of torque rods in a connecting direction with the mating connector, and a backward portion positioned backward from the turn center of said pair of torque rods in the connecting direction with the mating connector;

wherein the forward portion is provided with the hook to be latched on a latch being provided on the mating connector and the backward portion is provided with a finger depressing portion as a point of pressure;

wherein a front face of the hook provided on the forward portion of said lock arm is open in a direction of connection to the mating connector and a latch face of the hook is open in a direction opposite to the direction of connection to the mating connector, without being blocked by the pair of torque rods; and wherein the latch face of the hook has a same latch width as a lateral width of the lock arm, and the mating connector comprises the latch for being latched by the hook, the latch comprising:

a guide being open in the direction of connection to the mating connector, and a mating latch is disposed in opposition to the guide and formed to have a rectangular recess, wherein the rectangular recess is defined by an elongated portion connecting between sidewalls of the mating connector, wherein a width of the mating latch in internal wall of the recess is substantially the same as the latch face of the hook so that the hook can fit the mating latch.

2. The connector with the lock mechanism according to claim 1, wherein the hook is divided into two parts by a groove in the direction of connection to the mating connector.

3. The connector with the lock mechanism according to claim 1, wherein the hook is further provided on lateral sides of the hook with a pair of notches so as to facilitate insertion of the hook into the latch provided on the mating connector.

4. The connector with the lock mechanism according to claim 2, wherein the hook is further provided on lateral sides of the hook with a pair of notches so as to facilitate insertion of the hook into the latch provided on the mating connector.

5. An integrally formed lock structure capable of locking by engagement with a latch separate from the integrally formed lock structure, comprising:

a lock arm comprising a hook provided in a vicinity of a front end in a direction of engagement with the latch and a rear end in a direction opposite to the direction of engagement;

a pair of cylindrical torque rods projecting in opposing lateral directions from a fulcrum portion positioned between the front end and the rear end of the lock arm; and a pair of supports to which respective projecting tip ends of the pair of cylindrical torque rods are joined, wherein the pair of cylindrical torque rods supported by the pair of supports are twisted elastically such that the lock arm is turned around the fulcrum portion, wherein as the lock arm is extended beyond the pair of supports and is moved in the direction of engagement, the pair of cylindrical torque rods are twisted elastically such that the hook rides over the latch to a position engageable with the latch such that the elastically twisted pair of cylindrical torque rods are released at least partially so as to enable the hook to engage with the latch;

wherein the pair of cylindrical torque rods are twisted elastically by force applied on the rear end so as to turn the lock arm around the fulcrum portions such that the hook is disengaged from the latch, and wherein the lock arm is moved in the direction opposite to the direction of engagement such that the hook is released from the latch, wherein the latch comprising:

a guide being open in the direction of engagement with the latch and, a mating latch is disposed in opposition to the guide and formed to have a rectangular recess, wherein the rectangular recess is defined by an elongated portion connecting between sidewalls of the latch, wherein a width of the mating latch in an internal wall of the recess is substantially the same as a latch face of the hook so that the hook can fit the mating latch.

6. The integrally formed lock structure according to claim 5, wherein the lock arm is formed in a substantially rectangular parallelepiped defined by an upper surface, a lower surface, left and right side surfaces, a front surface, and a rear end surface, wherein the hook is integrally formed in the vicinity of the front end and on the lower surface of the rectangular parallelepiped such that the hook comprises a slope formed in a wedge shape in a lateral view of the hook and a latch face substantially perpendicular to the lower surface, the latch face being formed from an end of the slope, wherein the torque rods are integrally formed so as to project from the fulcrum portion on the left and right side surfaces, respectively; and wherein the pair of supports support the pair of torque rods such that sufficient clearances are provided above the upper surface and below the lower surface to enable the lock arm to turn about the torque rods.

7. The integrally formed lock structure according to claim 5, wherein the integrally formed lock structure can be formed with a combination of a forward slide mold and a backward slide mold by sliding the molds in parallel to the direction of engagement.

8. The integrally formed lock structure according to claim 6, wherein the integrally formed lock structure can be formed with a combination of a forward slide mold and a backward slide mold by sliding the molds in parallel to the direction of engagement.

9. The integrally formed lock structure according to claim 5, wherein outer surfaces of the integrally formed lock structure essentially consist of surfaces parallel to the direction of engagement, simple slope surfaces, and convex surfaces with respect to the direction of engagement.

10. The integrally formed lock structure according to claim 6, wherein outer surfaces of the integrally formed lock structure essentially consist of surfaces parallel to the direction of engagement, simple slope surfaces, and convex surfaces with respect to the direction of engagement.

11. The integrally formed lock structure according to claim 7, wherein outer surfaces of the integrally formed lock structure essentially consist of surfaces parallel to the direction of engagement, simple slope surfaces, and convex surfaces with respect to the direction of engagement.

12. The integrally formed lock structure according to claim 8, wherein outer surfaces of the integrally formed lock structure essentially consist of surfaces parallel to the direction of engagement, simple slope surfaces, and convex surfaces with respect to the direction of engagement.

13. A lockable connector provided on both side surfaces thereof with the integrally formed lock structure according to claim 5.

14. A lockable connector provided on both side surfaces thereof with the integrally formed lock structure according to claim 6.

15. A lockable connector provided on both side surfaces thereof with the integrally formed lock structure according to claim 7.

16. A lockable connector provided on both side surfaces thereof with the integrally formed lock structure according to claim 8.

17. A lockable connector provided on both side surfaces thereof with the integrally formed lock structure according to claim 9.

18. A lockable connector provided on both side surfaces thereof with the integrally formed lock structure according to claim 10.

* * * * *